US012276274B2

(12) United States Patent
Kawabata et al.

(10) Patent No.: US 12,276,274 B2
(45) Date of Patent: Apr. 15, 2025

(54) FLUID CONTROL DEVICE

(71) Applicant: Murata Manufacturing Co., Ltd., Kyoto (JP)

(72) Inventors: Yutoku Kawabata, Kyoto (JP); Nobuhira Tanaka, Kyoto (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 98 days.

(21) Appl. No.: 18/191,100

(22) Filed: Mar. 28, 2023

(65) Prior Publication Data

US 2023/0235732 A1 Jul. 27, 2023

Related U.S. Application Data

(63) Continuation of application No. PCT/JP2021/026240, filed on Jul. 13, 2021.

(30) Foreign Application Priority Data

Sep. 30, 2020 (JP) ..... 2020-164498

(51) Int. Cl.
*F04B 45/047* (2006.01)

(52) U.S. Cl.
CPC ..... *F04B 45/047* (2013.01)

(58) Field of Classification Search
CPC ..... F04B 43/02; F04B 43/04; F04B 43/046; F04B 45/04; F04B 45/047
See application file for complete search history.

(56) References Cited

U.S. PATENT DOCUMENTS 10,280,915 B2 * 5/2019 Kondo ..... F04B 53/10
2011/0076170 A1 * 3/2011 Fujisaki ..... F04B 45/047 417/415
2015/0056087 A1 * 2/2015 Hirata ..... F04B 43/046 417/413.2
2016/0377073 A1 * 12/2016 Tanaka ..... F04B 53/16 417/413.2

(Continued)

FOREIGN PATENT DOCUMENTS

CN 101960144 A * 1/2011 ..... F04B 35/04
CN 105508207 A * 4/2016

(Continued)

OTHER PUBLICATIONS

International Search Report for PCT/JP2021/026240 dated Aug. 24, 2021.

*Primary Examiner* — Alexander B Comley
(74) *Attorney, Agent, or Firm* — McDonald Hopkins LLC

(57) ABSTRACT

A fluid control device has a housing. A first main plate of the housing includes a vibration portion, on which a drive body is disposed, having a rotationally symmetric shape in plan view, and multiple openings which is formed outside the vibration portion and through which a pump chamber and the outside communicate with each other. A second main plate includes an opening through which the pump chamber and the outside communicate with each other and which has a rotationally symmetric shape in plan view. The opening is arranged to include the center of the vibration portion in plan view of the first main plate and the second main plate. An opening area of the opening is from 10% to 75% of an area of the vibration portion.

15 Claims, 5 Drawing Sheets

(56) References Cited

U.S. PATENT DOCUMENTS

| | | | | |
|---|---|---|---|---|
| 2017/0152845 | A1* | 6/2017 | Sasaki | F04D 33/00 |
| 2017/0215744 | A1* | 8/2017 | Kawamura | A61B 5/0235 |
| 2018/0100495 | A1* | 4/2018 | Tanaka | F04B 43/04 |
| 2019/0170133 | A1* | 6/2019 | Tanaka | F16K 99/0015 |
| 2021/0003226 | A1* | 1/2021 | Yokoi | F16K 15/141 |
| 2021/0010467 | A1 | 1/2021 | Fujisaki et al. | |

FOREIGN PATENT DOCUMENTS

| | | | | | |
|---|---|---|---|---|---|
| DE | 102008004147 | A1 | * | 7/2009 | F04B 43/043 |
| JP | 2009097393 | A | * | 5/2009 | |
| JP | 4795428 | B2 | * | 10/2011 | F04B 43/046 |
| WO | WO-2016063710 | A1 | * | 4/2016 | A61B 5/0235 |
| WO | WO-2016063711 | A1 | * | 4/2016 | F04B 39/102 |
| WO | WO-2017038565 | A1 | * | 3/2017 | F04B 43/02 |
| WO | WO-2019138675 | A1 | * | 7/2019 | F04B 43/04 |
| WO | WO-2019208016 | A1 | * | 10/2019 | F04B 43/02 |
| WO | 2019/230159 | A1 | | 12/2019 | |

* cited by examiner

FLUID CONTROL DEVICE

CROSS REFERENCE TO RELATED APPLICATION

This is a continuation of International Application No. PCT/JP2021/026240 filed on Jul. 13, 2021 which claims priority from Japanese Patent Application No. 2020-164498 filed on Sep. 30, 2020. The contents of these applications are incorporated herein by reference in their entireties.

BACKGROUND OF THE DISCLOSURE

Field of the Disclosure

The present disclosure relates to a fluid control device using a piezoelectric body.

Description of the Related Art

Patent Document 1 describes a fluid control device that conveys a fluid using a piezoelectric body. The fluid control device disclosed in Patent Document 1 includes a diaphragm, a cover plate, and a frame plate. The diaphragm and the cover plate are disposed to face each other with a predetermined distance therebetween. An outer peripheral end of the diaphragm and an outer peripheral end of the cover plate are connected by the frame plate. Thus, a pump chamber surrounded by the diaphragm, the cover plate, and the frame plate is formed. The diaphragm has suction holes in the vicinity of an outer periphery. The cover plate has small-diameter discharge holes. The piezoelectric body is placed on the diaphragm.

The diaphragm vibrates by the deformation of the piezoelectric body, and the volume of the pump chamber varies due to the vibration. The fluid control device uses the volume variation above to suck a fluid from the suction holes and to discharge the fluid from the discharge holes.

Patent Document 1: International Publication No. 2016/063710

BRIEF SUMMARY OF THE DISCLOSURE

However, for the fluid control device in the related art as described in Patent Document 1, it is difficult to have the increased volume variation of a pump chamber and to obtain a large flow rate.

Accordingly, a possible benefit of the present disclosure is to provide a fluid control device capable of providing the increased volume variation of a pump chamber.

A fluid control device according to the present disclosure includes a housing in which a pump chamber is formed using a first main plate and a second main plate facing each other, and a drive body disposed on the first main plate and configured to vibrate the first main plate. The first main plate includes a vibration portion, on which the drive body is disposed, having a rotationally symmetric shape in plan view, and a first opening which is formed outside the vibration portion and through which the pump chamber and the outside of the first main plate communicate with each other. The second main plate includes a second opening through which the pump chamber and the outside of the second main plate communicate with each other and which has a rotationally symmetric shape in plan view. The second opening is arranged to include the center of the vibration portion in plan view of the first main plate and the second main plate. An opening area of the second opening is from 10% to 75% of an area of the vibration portion.

In the configuration above, the region where the vibration portion and the second opening overlap each other does not substantially contribute to the volume variation. As a result, if a vibration is generated in which a phase at the center and a phase at an outer peripheral end in the vibration portion are opposite to each other, the mutual cancellation of the volume variation is suppressed.

For example, when the vibration portion is displaced to approach the second main plate at the center of the vibration portion, the outer peripheral end is displaced to be separated from the second main plate. In the case above, when the first main plate and the second main plate face each other substantially over the entire surface, the displacement contributes to the decrease in the volume of the pump chamber at the center and to the increase in the volume of the pump chamber at the outer peripheral end. With this, these volume variations cancel each other.

However, having the second opening at the center makes the volume variation of the pump chamber largely depend on the volume variation substantially at the outer peripheral end. As a result, the cancellation described above is suppressed.

According to the present disclosure, a pump chamber may have the increased volume variation, and a large flow rate may be obtained.

DETAILED DESCRIPTION OF THE DISCLOSURE

First Embodiment

Figure 1:
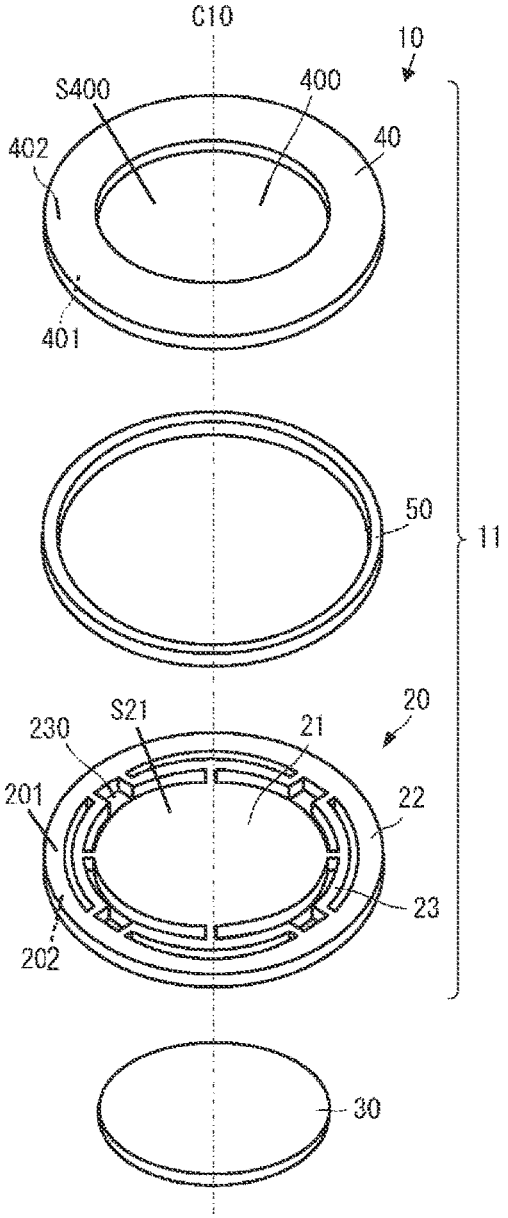
FIG. 1 is an exploded perspective view of a fluid control device 10 according to a first embodiment illustrating a configuration example.
Figure 2:
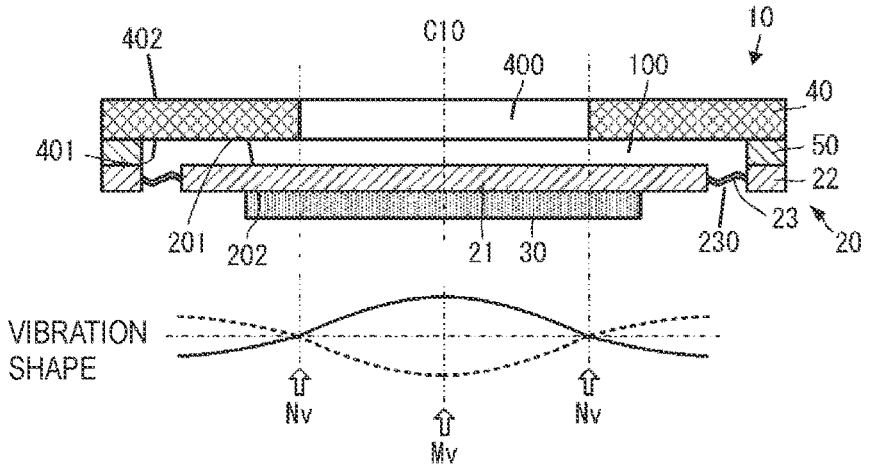
FIG. 2 is a side view of the fluid control device 10 according to the first embodiment illustrating a configuration example.

A fluid control device according to a first embodiment of the present disclosure will be described with reference to the drawings. FIG. 1 is an exploded perspective view of a fluid control device 10 according to the first embodiment illustrating a configuration example. FIG. 2 is a side view of the fluid control device 10 according to the first embodiment illustrating a configuration example. Note that, including the drawings above, in each of the drawings referred to in each embodiment below, in order to facilitate the explanation, the shape of each constituent is partially or entirely exaggerated.

As illustrated in FIG. 1 and FIG. 2, the fluid control device 10 includes a housing 11 and a drive body 30. The housing 11 includes a first main plate 20, a second main plate 40, and a connection member 50.

The first main plate 20 is a flat plate having a circular shape in plan view. The first main plate 20 has a main surface 201 and a main surface 202 parallel to each other. The first main plate 20 is made of metal or the like, for example. Note that an outer shape of the first main plate 20 is not limited to a circular shape. The first main plate 20 has a vibration portion 21, an outer frame portion 22, a support portion 23, and an opening 230.

The vibration portion 21 is a flat plate having a circular shape in plan view. Note that, it is sufficient that the vibration portion 21 has a rotationally symmetric shape in plan view. The vibration portion 21 is made of a material having a thickness which allows a bending vibration thereof by the drive body 30. The bending vibration is a vibration in which the first main plate 20 (the vibration portion 21) is displaced in a wave shape in side view as illustrated in a vibration shape in FIG. 2.

The outer frame portion 22 has an annular shape and is disposed outside an outer edge of the vibration portion 21. In plan view, the outer frame portion 22 surrounds the vibration portion 21.

The multiple support portions 23 are beam-shaped. The multiple support portions 23 are disposed between the vibration portion 21 and the outer frame portion 22. The multiple support portions 23 are connected to the outer edge of the vibration portion 21 and an inner edge of the outer frame portion 22. The multiple support portions 23 are disposed at intervals along the outer edge of the vibration portion 21.

The multiple openings 230 are disposed between the vibration portion 21 and the outer frame portion 22. The multiple openings 230 pass through the first main plate 20 between the main surface 201 and the main surface 202. The multiple openings 230 are portions where the multiple support portions 23 are not formed in a region between the vibration portion 21 and the outer frame portion 22. The opening 230 corresponds to a "first opening" according to the present disclosure.

With the configuration above, in the first main plate 20, the vibration portion 21 is supported by the multiple support portions 23 against the outer frame portion 22 to be able to vibrate.

Note that the vibration portion 21, the outer frame portion 22, and the multiple support portions 23 are preferably integrally formed. That is, the vibration portion 21, the outer frame portion 22, and the multiple support portions 23 are preferably realized by forming the multiple openings 230 with a predetermined method of punching a single flat plate. As a result, a shape allowing the vibration portion 21 and the outer frame portion 22 to be connected by the multiple support portions 23 and having the multiple openings 230 may easily be realized with high accuracy. Meanwhile, it is not required that the vibration portion 21, the outer frame portion 22, and the multiple support portions 23 are integrally formed. That is, the vibration portion 21, the outer frame portion 22, and the multiple support portions 23 may be realized by connecting individual members.

The second main plate 40 is a flat plate having a circular shape in plan view. Note that, it is sufficient that the outer shape of the second main plate 40 has a rotationally symmetric shape in plan view. The second main plate 40 has a main surface 401 and a main surface 402 parallel to each other. The second main plate 40 and the first main plate 20 are disposed such that the main surface 401 and the main surface 201 are separated and face each other.

The second main plate 40 has an opening 400. The opening 400 passes through the second main plate 40 between the main surface 401 and the main surface 402. The opening 400 has a circular shape in plan view. Note that, it is sufficient that the opening 400 has a rotationally symmetric shape in plan view.

The connection member 50 has an annular columnar body. It is preferable that the connection member 50 be made of a material with a thickness or the like that hardly causes a bending vibration.

The connection member 50 is disposed between the outer frame portion 22 and the second main plate 40. One end of the connection member 50 in a height direction is connected to the outer frame portion 22. The other end of the connection member 50 in the height direction is connected to the second main plate 40.

With the configuration above, in the fluid control device 10, a space (an internal space of the housing 11) surrounded by the first main plate 20, the second main plate 40, and the connection member 50 is a pump chamber 100 of the fluid control device 10. The pump chamber 100 communicates with the multiple openings 230 and the opening 400. In other words, the pump chamber 100 communicates with an external space of the first main plate 20 of the fluid control device 10 through the multiple openings 230 and communicates with an external space of the second main plate 40 of the fluid control device 10 through the opening 400.

The drive body 30 is realized by a piezoelectric element, for example. The piezoelectric element has a disk-shaped piezoelectric body and a driving electrode. The driving electrode is formed on each main surface of the disk-shaped piezoelectric body.

The drive body 30 is disposed on the main surface 202 of the vibration portion 21. In the case above, the center of the drive body 30 and the center of the vibration portion 21 substantially coincide with each other in plan view. The piezoelectric element of the drive body 30 is deformed by applying a drive signal to the driving electrodes. The vibration portion 21 is supported to be able to vibrate as described above. That is, the vibration portion 21 vibrates by the deformation.

By the vibration, the volume in the pump chamber 100 varies. By the variation, the fluid control device 10 sucks a fluid from the external space of the first main plate 20 into the pump chamber 100 through the multiple openings 230. Then, the fluid control device 10 discharges the fluid from an inside of the pump chamber 100 to the external space of the second main plate 40 through the opening 400.

Note that the fluid control device 10 may also suck a fluid from the external space of the second main plate 40 into the pump chamber 100 through the opening 400 and discharges the fluid from the inside of the pump chamber 100 to the external space of the first main plate 20 through the multiple openings 230. Either one of the two fluid conveyance modes is selectively executed.

(Operational Effect of Specific Shape and Position of Opening 400 and Area of Opening 400)

Figure 3:
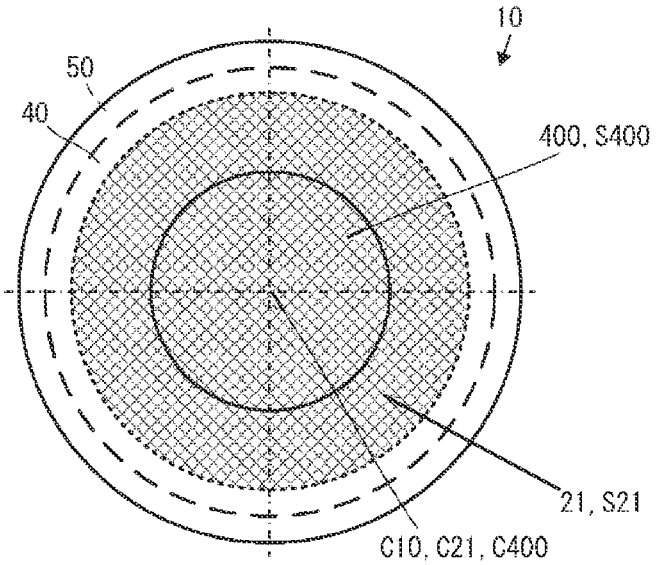
FIG. 3 is a plan view of the fluid control device 10 according to the first embodiment.

FIG. 3 is a plan view of the fluid control device 10 according to the first embodiment. FIG. 3 is a drawing in plan view from the side of the second main plate 40.

As illustrated in FIG. 3, the opening 400 has a circular shape in plan view as the same as the vibration portion 21, and a diameter of the opening 400 is smaller than a diameter of the vibration portion 21. That is, the opening 400 has a similar figure of an outer shape of the vibration portion 21. Note that, the opening 400 and the vibration portion 21 do not necessarily have completely similar figures but preferably have completely similar figures.

A center C400 of the opening 400 coincides with a center C21 of the vibration portion 21. In other words, the opening 400 is disposed to include the center C21 of the vibration portion 21. Note that, in the fluid control device 10, the center C400 of the opening 400 and the center C21 of the vibration portion 21 coincide with a center C10 of the fluid control device 10.

In the case above, an opening area S400 of the opening 400 (an opening area of the second main plate 40) is from 10% to 75% of an area S21 of the vibration portion 21.

Figure 4A:
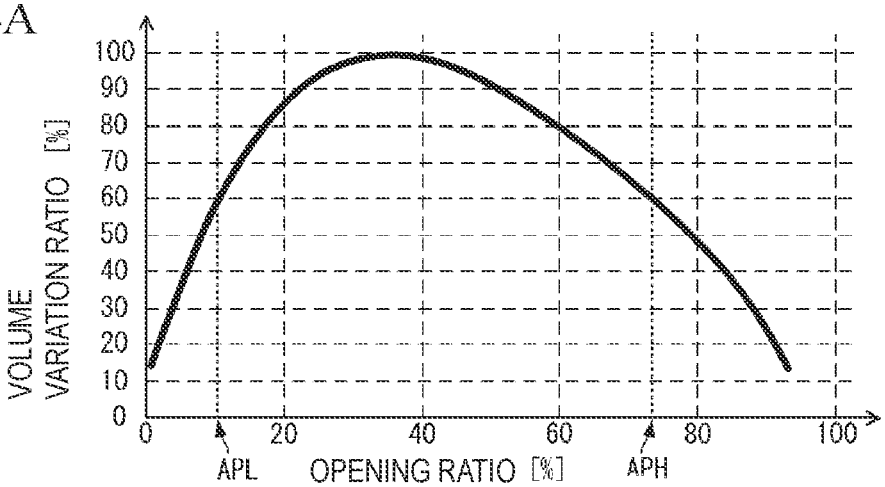
FIG. 4A is a graph showing a relationship between an opening ratio and a volume variation ratio.
Figure 4B:
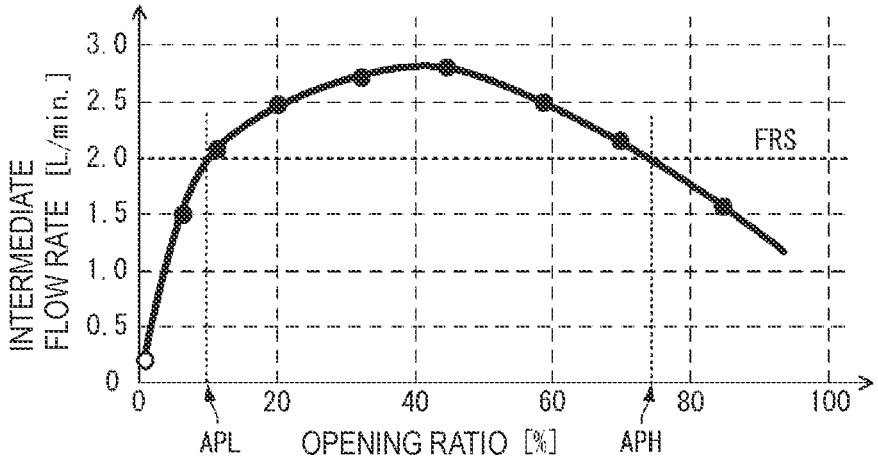
FIG. 4B is a graph showing a relationship between the opening ratio and an intermediate flow rate.

FIG. 4A is a graph showing a relationship between an opening ratio and a volume variation ratio, and FIG. 4B is a graph showing a relationship between the opening ratio and an intermediate flow rate. The opening ratio is a ratio of an area of the opening 400 to an area of the vibration portion 21. The volume variation ratio is a ratio of the minimum volume to the maximum volume of the pump chamber 100 in variation. The intermediate flow rate is a flow rate when the fluid control device 10 is driven at 50% of the maximum pressure value as a pump. Note that, in FIG. 4A, the volume variation ratio, at the opening ratio when the volume variation is largest, is shown as 100%.

As shown in FIG. 4A, when the opening ratio is changed, the volume variation ratio changes as well. The reason for the above is considered as follows.

As illustrated in FIG. 2, in the fluid control device 10, a vibration is generated in which a phase at the center and a phase at an outer peripheral end of the vibration portion 21 are opposite to each other.

Here, for example, in a configuration in the related art, since an opening of a flat plate facing a vibration portion (a facing flat plate: corresponding to the second main plate of the present application) is a hole having a small diameter, a vibration portion and the facing flat plate face each other substantially over an entire surface.

In the case above, for example, when the vibration portion is displaced to approach the facing flat plate at the center of the vibration portion, the outer peripheral end of the vibration portion is displaced to be separated from the facing flat plate. Accordingly, the displacement contributes to the decrease in the volume of the pump chamber at the center and to the increase in the volume of the pump chamber at the outer peripheral end. With this, these volume variations cancel each other.

Whereas, for example, when the vibration portion is displaced to be separated from the facing flat plate at the center of the vibration portion, the outer peripheral end of the vibration portion is displaced to approach the facing flat plate. Accordingly, the displacement contributes to the increase in the volume of the pump chamber at the center and to the decrease in the volume of the pump chamber at the outer peripheral end. With this, these volume variations cancel each other.

As a result, with a configuration in the related art, the volume variation ratio is small.

Whereas, in the present disclosure, the opening 400 overlaps the vibration portion 21 over a large area. Since the region where the vibration portion 21 and the opening 400 overlap each other communicates with the external space, the vibration of the vibration portion 21 does not substantially contribute to the volume variation of the pump chamber 100. That is, with the configuration of the present disclosure, the vibration of the vibration portion 21 at the center (the portion where the vibration portion 21 and the opening 400 overlap each other) of the vibration portion 21 hardly affects the volume variation of the pump chamber 100. With this, in the configuration of the present disclosure, the volume variation of the pump chamber 100 depends on the volume variation at the outer peripheral end (the portion where the vibration portion 21 and the second main plate 40 overlap each other) of the vibration portion 21.

For example, when the vibration portion 21 is displaced to approach the opening 400 of the second main plate 40 at the center of the vibration portion 21, the outer peripheral end of the vibration portion 21 is displaced to be separated from the second main plate 40. In the case above, the volume of the pump chamber 100 varies to increase in accordance with an increase in the volume at the outer peripheral end of the vibration portion 21.

Whereas, when the vibration portion 21 is displaced to be separated from the opening 400 of the second main plate 40 at the center of the vibration portion 21, the outer peripheral end of the vibration portion 21 is displaced to approach the second main plate 40. In the case above, the volume of the pump chamber 100 varies to decrease in accordance with a decrease in the volume at the outer peripheral end of the vibration portion 21.

As described above, with the use of the configuration of the present disclosure, the cancellation of the volume variation at the center and at the outer peripheral end of the vibration portion 21 in each vibration state is suppressed. As a result, the fluid control device 10 may have the increased volume variation ratio. Then, in the fluid control device 10, the increased volume variation ratio may increase the intermediate flow rate.

In the case above, when the opening area S400 of the opening 400 is too close to the area S21 of the vibration portion 21, the volume of the outer peripheral end portion contributing to the volume variation becomes small. Accordingly, as shown in FIG. 4A, when the opening area S400 of the opening 400 is too close to the area S21 of the vibration portion 21, the volume variation ratio becomes small. As a result, as shown in FIG. 4B, when the opening area S400 of the opening 400 is too close to the area S21 of the vibration portion 21, the intermediate flow rate becomes small as well.

Then, in the fluid control device 10, the opening area S400 of the opening 400 relative to the area S21 of the vibration portion 21 is set from a predetermined minimum value APL (10% in the case of FIG. 4A, for example) to a predetermined maximum value APH (75% in the case of FIG. 4A, for example). As a result, the fluid control device 10 may achieve a volume variation ratio of a desired value (60% in the case of FIG. 4A, for example) or more.

Then, by achieving the volume variation ratio above, the fluid control device 10 may achieve an intermediate flow rate of a desired reference value FRS or more. For example, in the case of FIG. 4A and FIG. 4B, an intermediate flow rate of 2.0 L/min. or more may be achieved by setting the volume variation ratio to 60% or more (the opening ratio is in the range from 10% to 75%).

Figure 5A:
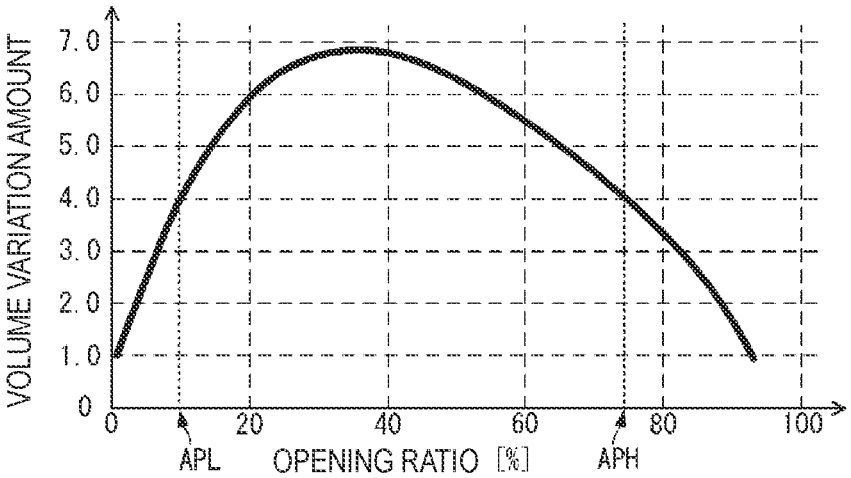
FIG. 5A is a graph showing a relationship between an opening ratio and a volume variation amount.
Figure 5B:
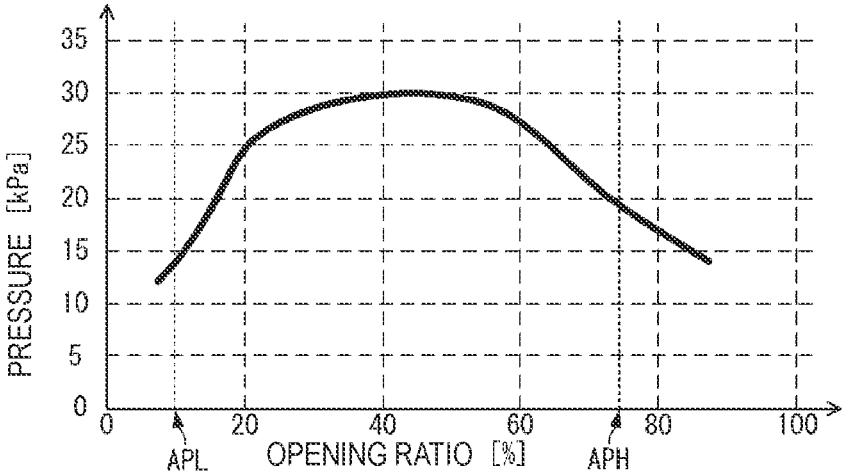
FIG. 5B is a graph showing a relationship between the opening ratio and the pressure.

FIG. 5A is a graph showing a relationship between an opening ratio and a volume variation amount, and FIG. 5B is a graph showing a relationship between the opening ratio and the pressure. The pressure is a discharge pressure of a fluid. In FIG. 5A, the volume variation amount of a configuration in the related art is shown as 1.0 (comparative reference value). Note that, in the configuration in the related art, a facing flat plate (a flat plate having the same meaning as the second main plate of the present application) has a small-diameter opening, and an opening ratio is 0.3%.

As shown in FIG. 5A, with the use of the configuration of the present disclosure, the volume variation amount is approximately 4.0 times or more as compared with the configuration in the related art. Correspondingly, the intermediate flow rate significantly increases as well. Then, in the case above, as shown in FIG. 5B, with the use of the configuration of the present disclosure, if the opening is large, the pressure does not decrease.

As a result, the fluid control device 10 may have the increased volume variation of the pump chamber 100 and may obtain a large flow rate. Then, the fluid control device 10 may suppress a decrease in the pressure. That is, the fluid control device 10 may greatly improve the fundamental characteristics as a pump.

Note that, in the fluid control device 10, 2.0 L/min. is set as a reference value FRS of the intermediate flow rate. However, the reference value FRS may be changed in accordance with the specification of the fluid control device 10. Then, by changing the reference value FRS, the minimum value of the volume variation ratio may be changed as well, thereby making it possible to change the range of the opening ratio as well.

Note that, in the configuration described above, a case is described in which the center C400 of the opening 400 and the center C21 of the vibration portion 21 coincide with each other and both the opening 400 and the vibration portion 21 have a circular shape and have completely similar figures. However, as described above, it is not necessary that the center C400 of the opening 400 and the center C21 of the vibration portion 21 completely coincide with each other or that both the opening 400 and the vibration portion 21 have a circular shape or have completely similar figures.

Figure 6:
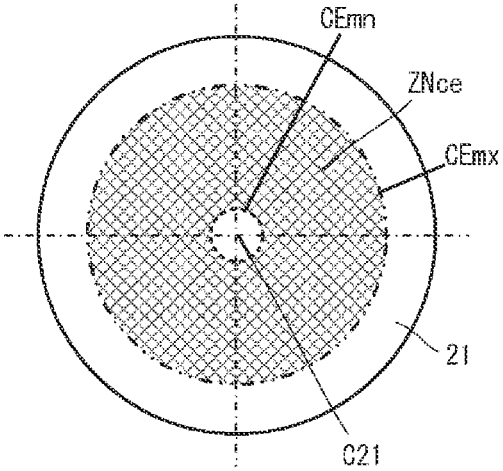
FIG. 6 is a plan view illustrating a settable range of an outer peripheral end of an opening 400.
Figure 7A:
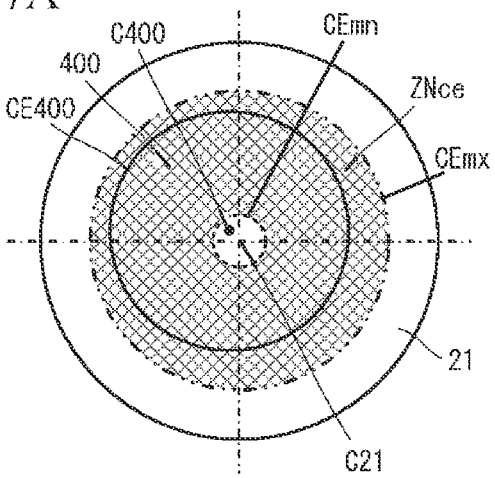
FIG. 7A and FIG. 7B are plan views illustrating examples of a position and a shape of an opening.
Figure 7B:
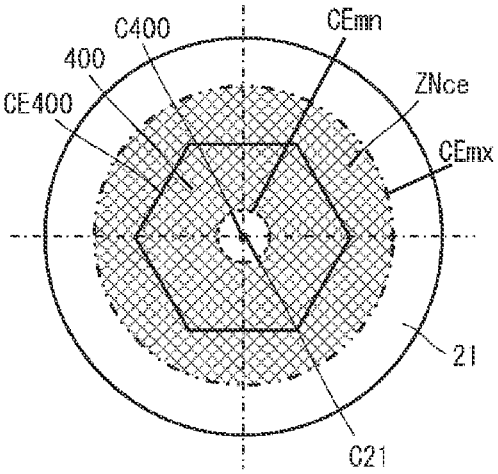

FIG. 6 is a plan view illustrating a settable range of an outer peripheral end of the opening 400. FIG. 7A and FIG. 7B are plan views illustrating examples of a position and a shape of the opening 400.

As illustrated in FIG. 6, a setting range ZNce of the outer peripheral end of the opening 400 is set by an annular region between a circular minimum side boundary CEmn and a circular maximum side boundary CEmx. The center of the setting range ZNce coincides with the center C21 of the vibration portion 21 in plan view. A center of the minimum side boundary CEmn and a center of the maximum side boundary CEmx also coincide with the center C21 of the vibration portion 21 in plan view. The minimum side boundary CEmn is set with a circle having an area of 10% of that of the vibration portion 21. The maximum side boundary CEmx is set with a circle having an area of 75% of that of the vibration portion 21.

The opening 400 is set such that the outer periphery thereof falls within the setting range ZNce. For example, in the case of FIG. 7A, the opening 400 has a circular shape, but the center C400 of the opening 400 and the center C21 of the vibration portion 21 do not coincide with each other. However, an outer periphery CE400 of the opening 400 falls within the setting range ZNce. In the case of FIG. 7B, the center C400 of the opening 400 and the center C21 of the vibration portion 21 coincide with each other, but the opening 400 has a regular hexagonal shape. However, the outer periphery CE400 of the opening 400 falls within the setting range ZNce.

Also with the configuration above, the fluid control device 10 may achieve the operational effect described above. Note that, also in a case that the center C400 of the opening 400 and the center C21 of the vibration portion 21 do not coincide with each other and the opening 400 and the vibration portion 21 do not have similar figures, when the outer periphery CE400 of the opening 400 falls within the setting range ZNce, the fluid control device 10 may achieve the operational effect described above. In the case above, it is preferable that the vibration portion 21 and the opening 400 have a point symmetrical shape in plan view, and it is more preferable that the shape be a regular polygon having a large number of corners or a circle.

Note that, in FIG. 2, a mode is illustrated in which the outer peripheral end of the opening 400 coincides with a node Nv of a vibration having an antinode Mv at the center of the vibration portion 21. However, the positional relationship between the outer peripheral end of the opening 400 and the node Nv of a vibration is not limited thereto, and it is sufficient that the outer peripheral end of the opening 400 falls within the range described above. Meanwhile, when the outer peripheral end of the opening 400 and the node Nv of a vibration substantially coincide with each other, the entire portion of the vibration portion 21 outside the node Nv may contribute to the volume variation, which is more effective.

Second Embodiment

Figure 8:
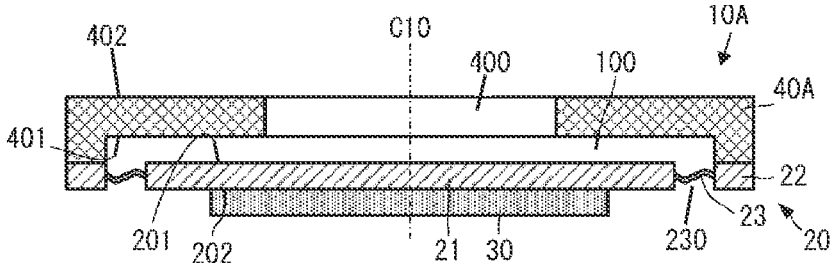
FIG. 8 is a side view of a fluid control device 10A according to a second embodiment illustrating a configuration example.

A fluid control device according to a second embodiment of the present disclosure will be described with reference to the drawings. FIG. 8 is a side view of a fluid control device 10A according to the second embodiment illustrating a configuration example.

As illustrated in FIG. 8, the fluid control device 10A according to the second embodiment is different from the fluid control device 10 according to the first embodiment in that a second main plate and a connection member are integrally formed. The other configurations of the fluid control device 10A are the same as those of the fluid control device 10, and a description of the same portions will be omitted.

The fluid control device 10A includes a second main plate 40A. The second main plate 40A has a recessed portion having a shape overlapping the vibration portion 21, the multiple support portions 23, and the multiple openings 230, on the side of the first main plate 20. An outer peripheral portion of the second main plate 40A surrounding the recessed portion is connected to the first main plate 20.

In the configuration above, the fluid control device 10A may omit a connection member. As a result, the fluid control device 10A may reduce the number of constituents while achieving the same operational effect as that of the fluid control device 10. Note that the connection member of the fluid control device 10 may be added to the configuration of the fluid control device 10A.

Third Embodiment

Figure 9:
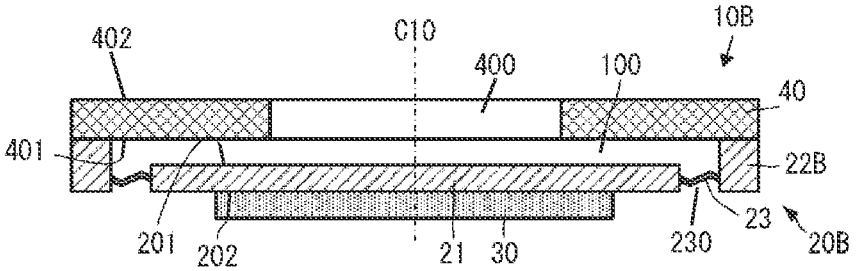
FIG. 9 is a side view of a fluid control device 10B according to a third embodiment illustrating a configuration example.

A fluid control device according to a third embodiment of the present disclosure will be described with reference to the drawings. FIG. 9 is a side view of a fluid control device 10B according to the third embodiment illustrating a configuration example.

As illustrated in FIG. 9, the fluid control device 10B according to the third embodiment is different from the fluid control device 10 according to the first embodiment in that a first main plate and a connection member are integrally formed. The other configurations of the fluid control device 10B are the same as those of the fluid control device 10, and a description of the same portions will be omitted.

The fluid control device 10B includes a first main plate 20B. The first main plate 20B includes an outer frame portion 22B. The outer frame portion 22B is thicker than the vibration portion 21 and the multiple support portions 23 and has a shape protruding to the side of the second main plate 40. The outer frame portion 22B is connected to the second main plate 40.

In the configuration above, the fluid control device 10B may omit a connection member. As a result, the fluid control device 10B may reduce the number of constituents while achieving the same operational effect as that of the fluid control device 10. Note that the connection member of the fluid control device 10 may be added to the configuration of the fluid control device 10B. Furthermore, the configuration of the second main plate 40A of the fluid control device 10A may be combined with the configuration of the first main plate 20B of the fluid control device 10B, and further, a connection member may be added thereto.

Further, in the configuration of the fluid control device 10 and the configuration of the fluid control devices 10A and 10B to which the connection member is added, using a connection member may realize the height of the pump chamber 100 with high accuracy. As a result, the volume variation ratio and the volume variation amount may be set with high accuracy.

Fourth Embodiment

Figure 10:
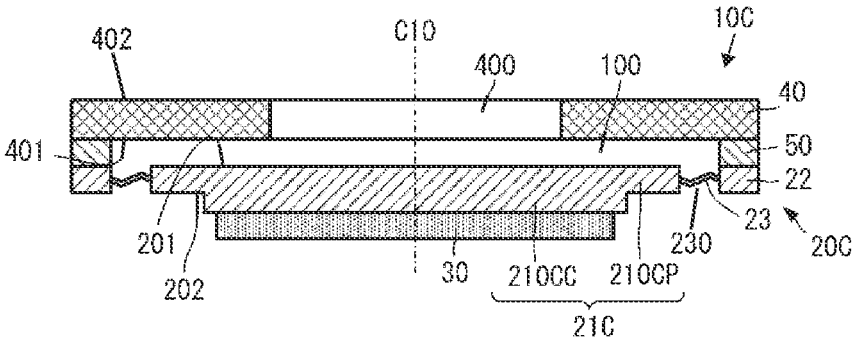
FIG. 10 is a side view of a fluid control device 10C according to a fourth embodiment illustrating a configuration example.

A fluid control device according to a fourth embodiment of the present disclosure will be described with reference to the drawings. FIG. 10 is a side view of a fluid control device 10C according to the fourth embodiment illustrating a configuration example.

As illustrated in FIG. 10, the fluid control device 10C according to the fourth embodiment is different from the fluid control device 10 according to the first embodiment in the shape of a vibration portion of a first main plate. The other configurations of the fluid control device 10C are the same as those of the fluid control device 10, and a description of the same portions will be omitted.

The fluid control device 10C includes a first main plate 20C. The first main plate 20C includes a vibration portion 21C. The vibration portion 21C includes a central portion 210CC and a peripheral portion 210CP. The central portion 210CC is smaller than the vibration portion 21C in a planar area and includes a center of the vibration portion 21C. The peripheral portion 210CP is disposed to surround the outer periphery of the central portion 210CC. The central portion 210CC is thicker than the peripheral portion 210CP.

With the configuration above, the fluid control device 10C may have a greater vibration in the peripheral portion 210CP on a side of the outer peripheral end of the vibration portion 21C, without increasing a voltage to drive the drive body 30 for vibration. As a result, the fluid control device 10C may have the increased volume variation ratio and volume variation amount and may further increase the flow rate.

Further, it is preferable that the area of the central portion 210CC be larger than that of the opening 400. In the fluid control device 10C, in a mode in which a fluid flows into from the opening 400, the vibration portion 21C is pressed by the fluid. When the vibration portion 21C is pressed by the fluid, the vibration of the vibration portion 21C is suppressed and a large displacement cannot be obtained. The portion where the fluid presses is a portion where the opening 400 and the vibration portion 21C overlap each other in plan view. Therefore, increasing the thickness of the overlapping portion makes it possible not to be affected by the pressing of the fluid and enables the vibration portion 21C to obtain a large displacement.

Note that, as described above, the vibration portion 21C preferably protrudes to a side opposite to a side of the pump chamber 100. With the configuration above, it is possible for the central portion 210CC to avoid coming into contact with the second main plate 40 during the vibration of the vibration portion 21C. Furthermore, it is more preferable that the central portion 210CC be flush with the peripheral portion 210CP in the main surface 201 of the vibration portion 21C on the side of the pump chamber 100. In the configuration above, since the main surface 201 of the vibration portion 21C is flat, it is possible for the central portion 210CC to avoid coming into contact with the second main plate 40 during the vibration of the vibration portion 21C.

Fifth Embodiment

Figure 11:
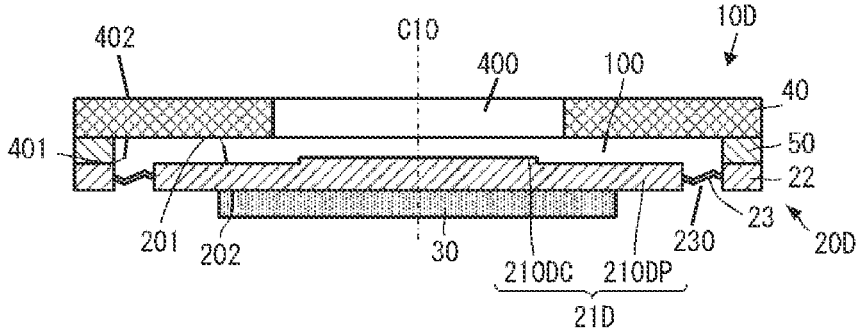
FIG. 11 is a side view of a fluid control device 10D according to a fifth embodiment illustrating a configuration example.

A fluid control device according to a fifth embodiment of the present disclosure will be described with reference to the drawings. FIG. 11 is a side view of a fluid control device 10D according to the fifth embodiment illustrating a configuration example.

As illustrated in FIG. 11, the fluid control device 10D according to the fifth embodiment is different from the fluid control device 10 according to the first embodiment in the shape of a vibration portion of a first main plate. The other configurations of the fluid control device 10D are the same as those of the fluid control device 10, and a description of the same portions will be omitted.

The fluid control device 10D includes a first main plate 20D. The first main plate 20D includes a vibration portion 21D. The vibration portion 21D includes a central portion 210DC and a peripheral portion 210DP. The central portion 210DC is smaller than the vibration portion 21D in a planar area and includes a center of the vibration portion 21D. The peripheral portion 210DP is disposed to surround an outer periphery of the central portion 210DC. The central portion 210DC is thicker than the peripheral portion 210DP. The central portion 210DC protrudes relative to the peripheral portion 210DP on a surface (the main surface 201 of the vibration portion 21D) of the vibration portion 21D on the side of the pump chamber 100. Further, the central portion 210DC is flush with the peripheral portion 210DP in the main surface 202 on a side opposite to the side of the pump chamber 100.

With the configuration above, the fluid control device 10D may have a greater vibration in the peripheral portion 210DP on a side of the outer peripheral end of the vibration portion 21D, without increasing a voltage to drive the drive body 30 for vibration. As a result, the fluid control device 10D may have the increased volume variation ratio and volume variation amount and may further increase the flow rate.

Note that, in the fluid control device 10D, it is preferable that the central portion 210DC of the vibration portion 21D overlap the opening 400 in plan view and that the area of the central portion 210DC is smaller than the area of the opening 400. As a result, it is possible to more reliably suppress the contact of the central portion 210DC with the second main plate 40 during the vibration of the vibration portion 21D.

Further, in the fluid control device 10D, the surface of the vibration portion 21D, on a side on which the drive body 30 is placed, is flat. Accordingly, the fluid control device 10D, as compared with the fluid control device 10C, may have the increased flexibility of a shape of the drive body 30.

Sixth Embodiment

Figure 12:
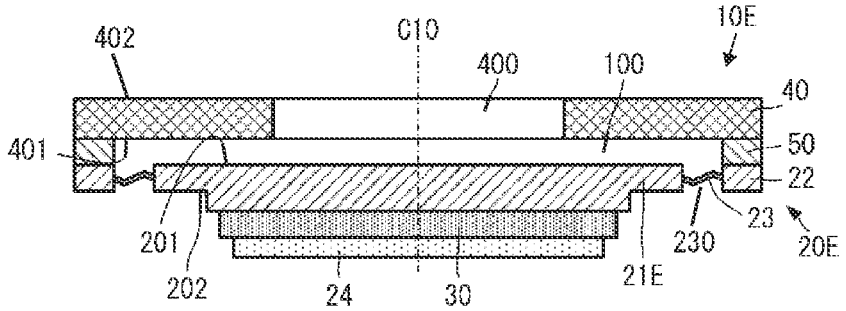
FIG. 12 is a side view of a fluid control device 10E according to a sixth embodiment illustrating a configuration example.

A fluid control device according to a sixth embodiment of the present disclosure will be described with reference to the drawings. FIG. 12 is a side view of a fluid control device 10E according to the sixth embodiment illustrating a configuration example.

As illustrated in FIG. 12, the fluid control device 10E according to the sixth embodiment is different from the fluid control device 10C according to the fourth embodiment in that a flat plate 24 is added. The other configurations of the fluid control device 10E are the same as those of the fluid control device 10C, and a description of the same portions will be omitted. Note that a first main plate 20E has the same configuration as that of the first main plate 20C.

The fluid control device 10E includes the flat plate 24 having a flat plate shape. The flat plate 24 is disposed on a surface of the drive body 30 on a side opposite to a surface with which a vibration portion 21E comes into contact.

With the configuration above, the fluid control device 10E may have a greater vibration in the outer peripheral end of the vibration portion 21E, without increasing a voltage to drive the drive body 30 for vibration. As a result, the fluid control device 10E may have further increased volume variation ratio and volume variation amount and may further increase the flow rate.

Seventh Embodiment

Figure 13A:
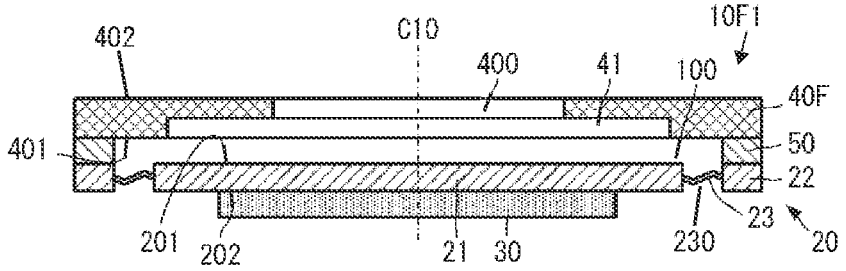
FIG. 13A and FIG. 13B are side views of fluid control devices 10F1 and 10F2 according to a seventh embodiment.
Figure 13B:
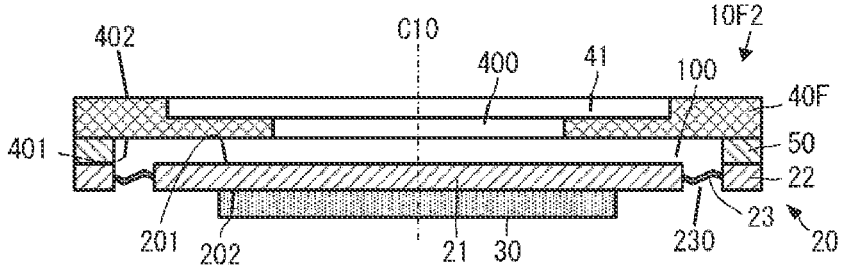

A fluid control device according to a seventh embodiment of the present disclosure will be described with reference to the drawings. FIG. 13A and FIG. 13B are side views of fluid control devices 10F1 and 10F2 according to the seventh embodiment.

As illustrated in FIG. 13A and FIG. 13B, the fluid control devices 10F1 and 10F2 according to the seventh embodiment each are different from the fluid control device 10 according to the first embodiment in a shape of a second main plate 40F. The other configurations of each of the fluid control devices 10F1 and 10F2 are the same as those of the fluid control device 10, and a description of the same portions will be omitted.

As illustrated in FIG. 13A and FIG. 13B, the fluid control devices 10F1 and 10F2 each include the second main plate 40F. The second main plate 40F has a recessed portion 41. The recessed portion 41 has a shape recessed from one main surface of the second main plate 40F. The planar area of the recessed portion 41 is larger than the planar area of the opening 400. The opening 400 is formed to pass through a bottom of the recessed portion 41.

As illustrated in FIG. 13A, in the fluid control device 10F1, the recessed portion 41 is formed on a side of the main surface 401 of the second main plate 40F, and the recessed portion 41 is on a side of the pump chamber 100 (a side of the vibration portion 21).

As illustrated in FIG. 13B, in the fluid control device 10F2, the recessed portion 41 is formed on a side of the main surface 402 of the second main plate 40F, and the recessed portion 41 is on a side of the external space.

With the configurations above, in the fluid control devices 10F1 and 10F2, the second main plate 40F is thin in a portion having the recessed portion 41. As a result, the second main plate 40F vibrates together with the vibration portion 21. In the case above, by appropriately setting the shape of the recessed portion 41, a frequency of the vibration of the vibration portion 21 and a frequency of the vibration of the second main plate 40F may be made substantially the same, and a phase of the vibration of the vibration portion 21 and a phase of the vibration of the second main plate 40F may be made opposite to each other. As a result, in the fluid control devices 10F1 and 10F2, the volume variation ratio and the volume variation amount may be increased, and the intermediate flow rate may be increased.

Further, in the configuration illustrated in FIG. 13B, for example, by setting the area of the recessed portion 41 to be equal to or larger than the area of the vibration portion 21, it is possible to more reliably suppress the contact of the vibration portion 21 and the second main plate 40F when the vibration portion 21 and the second main plate 40F vibrate.

Further, in the fluid control devices 10F1 and 10F2 described above, a mode is described in which the recessed portion 41 is provided. However, in the fluid control devices 10F1 and 10F2, it is sufficient that a portion of the second main plate 40F adjacent to the opening 400 is thinner than a portion overlapping the outer frame portion 22 in plan view of the second main plate 40F.

Eighth Embodiment

Figure 14:
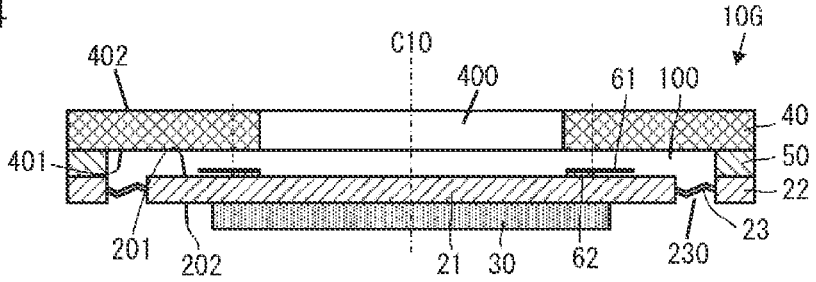
FIG. 14 is a side view of a fluid control device 10G according to an eighth embodiment illustrating a configuration example.

A fluid control device according to an eighth embodiment of the present disclosure will be described with reference to the drawings. FIG. 14 is a side view of a fluid control device 10G according to the eighth embodiment illustrating a configuration example.

As illustrated in FIG. 14, the fluid control device 10G according to the eighth embodiment is different from the fluid control device 10 according to the first embodiment in that a valve member is provided. The other configurations of the fluid control device 10G are the same as those of the fluid control device 10, and a description of the same portions will be omitted. Note that the fluid control device 10G is illustrated to operate in a mode in which a fluid is sucked from the opening 400 and is discharged from the multiple openings 230.

As illustrated in FIG. 14, the fluid control device 10G includes a valve membrane 61 and a fixing member 62.

The valve membrane 61 is made of a flexible material. It is sufficient that the valve membrane 61 has elasticity that makes it deformed by a fluid flowing through the pump chamber 100. The valve membrane 61 has an annular shape and has a predetermined width (a length in a radial direction). An outer peripheral end of the valve membrane 61 overlaps the second main plate 40 in plan view.

The fixing member 62 is made of an adhesive material such as a double-sided tape, for example. The fixing member 62 has an annular shape and has a predetermined width (a length in the radial direction). A width of the fixing member 62 is less than a width of the valve membrane 61. An outer diameter of the fixing member 62 is smaller than an outer diameter of the valve membrane 61.

The fixing member 62 fixes the valve membrane 61 to the main surface 201 of the vibration portion 21. In the case above, a center of the fixing member 62 substantially coincides with the center of the vibration portion 21. Further, the fixing member 62 fixes an end portion of the valve membrane 61 on a side of an inner periphery and does not fix a side of an outer periphery.

With the configuration above, when a fluid flows into from the opening 400, the valve membrane 61 bends toward a side of the vibration portion 21 and does not hinder the conveyance of the fluid. Accordingly, the fluid flows through the multiple openings 230 and is discharged to the external space. Whereas, when a fluid flows into from the multiple openings 230, the valve membrane 61 curves toward the side of the second main plate 40 and comes into contact with the main surface 401 of the second main plate 40. Accordingly, the fluid conveyance in the pump chamber 100 is stopped and the fluid is not conveyed to the opening 400.

As a result, the fluid control device 10G may more reliably convey a fluid in one direction.

Note that, in the configuration of the fluid control device 10G, it is preferable that the position (a position indicated by dotted line in FIG. 14) of the end portion of the fixing member 62 on a side of the outer periphery be outside the outer peripheral end of the opening 400 (the position does not overlapping the opening 400). As a result, the valve membrane 61 more reliably comes into contact with the second main plate 40.

Further, the fluid control device 10G is illustrated as a case in which a fluid is sucked from the opening 400 and discharged from the multiple openings 230. However, the configuration of the present embodiment having a valve may also be applied to a mode in which a fluid is sucked from the multiple openings 230 and discharged from the opening 400. In the case above, the valve membrane 61 is disposed in a state that a side of the outer peripheral end is fixed and an inner peripheral end is not fixed.

The configurations of the embodiments described above may appropriately be combined, and an operational effect corresponding to each combination may be obtained.

10, 10A, 10B, 10C, 10D, 10E, 10F1, 10F2, 10G FLUID CONTROL DEVICE
11 HOUSING
20, 20B, 20C, 20D, 20E FIRST MAIN PLATE
21, 21C, 21D, 21E VIBRATION PORTION
22, 22B OUTER FRAME PORTION
23 SUPPORT PORTION
24 FLAT PLATE
30 DRIVE BODY
40, 40A, 40F SECOND MAIN PLATE
41 RECESSED PORTION
50 CONNECTION MEMBER
61 VALVE MEMBRANE
62 FIXING MEMBER
100 PUMP CHAMBER
201, 202 MAIN SURFACE
210CC, 210DC CENTRAL PORTION
210CP, 210DP PERIPHERAL PORTION
230, 400 OPENING
401, 402 MAIN SURFACE

The invention claimed is:

1. A fluid control device, comprising:

a housing, wherein a pump chamber is provided in the housing using a first main plate and a second main plate facing each other; and a drive body disposed on the first main plate and configured to vibrate the first main plate, wherein the first main plate includes a vibration portion, an outer frame portion, a support portion, and a first opening, the drive body being disposed on the vibration portion, and the vibration portion having a rotationally symmetric shape in plan view, the outer frame portion being positioned outside the vibration portion, the support portion connecting the vibration portion and the outer frame portion, and the first opening being surrounded by the vibration portion, the outer frame portion, and the support portion, and the pump chamber and an outside of the first main plate communicating with each other through the first opening, wherein the second main plate includes a second opening, the pump chamber and an outside of the second main plate communicating with each other through the second opening, and the second opening having a rotationally symmetric shape in plan view, wherein the second opening is arranged to overlap a center of the vibration portion of the first main plate in plan view and a center of the second main plate in plan view, wherein an opening area of the second opening is from 10% to 75% of an area of the vibration portion, wherein the vibration portion has a central portion including the center in plan view and a peripheral portion surrounding the central portion, wherein the central portion is thicker than the peripheral portion, wherein the central portion has a shape protruding to a side of the pump chamber relative to the peripheral portion, and wherein the central portion is located within the second opening in plan view.

2. The fluid control device according to claim 1, wherein the housing includes a connection member disposed between the outer frame portion and the second main plate.

3. The fluid control device according to claim 2, further comprising:

a flat plate mounted on the drive body.

4. The fluid control device according to claim 2, wherein, a portion of the second main plate adjacent to the second opening is thinner than a portion of the second main plate overlapping the outer frame portion in plan view.

5. The fluid control device according to claim 1, wherein an outer periphery of the central portion overlaps a portion of the second main plate not having the second opening in plan view.

6. The fluid control device according to claim 5, wherein the central portion has a shape further protruding to a side opposite to the side of the pump chamber relative to the peripheral portion.

7. The fluid control device according to claim 6, further comprising:

a flat plate mounted on the drive body.

8. The fluid control device according to claim 5, further comprising:

a flat plate mounted on the drive body.

9. The fluid control device according to claim 5, wherein, a portion of the second main plate adjacent to the second opening is thinner than a portion of the second main plate overlapping the outer frame portion in plan view.

10. The fluid control device according to claim 1, further comprising:

a flat plate mounted on the drive body.

11. The fluid control device according to claim 1, wherein, a portion of the second main plate adjacent to the second opening is thinner than a portion of the second main plate overlapping the outer frame portion in plan view.

12. The fluid control device according to claim 11, wherein the portion adjacent to the second opening has a shape recessed into the second main plate on or toward the side of the pump chamber.

13. The fluid control device according to claim 1, further comprising:

a valve member disposed in the pump chamber between the first main plate and the second main plate.

14. The fluid control device according to claim 13, wherein the valve member includes an annular valve membrane and a fixing member fixing an end portion of the valve membrane on a side of an outer periphery to the first main plate or the second main plate, and an end portion of the fixing member on a side of an inner periphery does not overlap the second opening.

15. A fluid control device, comprising:

a housing, wherein a pump chamber is provided in the housing using a first main plate and a second main plate facing each other; and a drive body disposed on the first main plate and configured to vibrate the first main plate, wherein the first main plate includes a vibration portion, an outer frame portion, a support portion, and a first opening, the drive body being disposed on the vibration portion, and the vibration portion having a rotationally symmetric shape in plan view, the outer frame portion being positioned outside the vibration portion, the support portion connecting the vibration portion and the outer frame portion, and the first opening being surrounded by the vibration portion, the outer frame portion, and the support portion, and the pump chamber and an outside of the first main plate communicating with each other through the first opening, wherein the second main plate includes a second opening, the pump chamber and an outside of the second main plate communicating with each other through the second opening, and the second opening having a rotationally symmetric shape in plan view, wherein the second opening is arranged to overlap a center of the vibration portion of the first main plate in plan view and a center of the second main plate in plan view, wherein an opening area of the second opening is from 10% to 75% of an area of the vibration portion, wherein a valve member is disposed in the pump chamber between the first main plate and the second main plate, wherein the valve member includes:

an annular valve membrane, and a fixing member fixing an end portion of the valve membrane on a side of an outer periphery to the first main plate or the second main plate, and wherein an end portion of the fixing member on a side of an inner periphery does not overlap the second opening.

* * * * *